US005695313A

United States Patent [19]

Gross et al.

[11] Patent Number: 5,695,313

[45] Date of Patent: Dec. 9, 1997

[54] DEVICE FOR LAYING ON AND STACKING OFF CUT STACKS OF SHEETS OF MATERIAL

[75] Inventors: Helmut Gross; Albrecht Schnatz, both of Hofheim, Germany

[73] Assignee: Adolf Mohr Maschinenfabrik GmbH & Co. KG, Hofheim am Taunus, Germany

[21] Appl. No.: 615,490

[22] Filed: Aug. 12, 1996

[30] Foreign Application Priority Data

Mar. 14, 1995 [DE] Germany ..... 195 08 667.8

[51] Int. Cl.[6] ..... B65G 57/03

[52] U.S. Cl. ..... 414/793.4; 414/792.9; 414/792.8; 414/789.9; 414/788.9

[58] Field of Search ..... 414/788.8, 788.9, 414/789, 789.9, 792.8, 792.9, 793.4, 794.3, 903, 924

[56] References Cited

U.S. PATENT DOCUMENTS

| | | | |
|---|---|---|---|
| 3,017,041 | 1/1962 | Hawkes | 414/796 |
| 3,022,904 | 2/1962 | Shires | 414/792.9 |
| 3,338,431 | 8/1967 | Thedick | 414/794.3 |
| 3,405,932 | 10/1968 | Dame | 493/17 |
| 3,516,653 | 6/1970 | Bland | 270/58.04 |
| 3,521,770 | 7/1970 | Rossi | 414/793.4 |
| 4,055,261 | 10/1977 | Schneider | 414/792.9 |
| 4,249,847 | 2/1981 | Tokuno | 414/795.8 |
| 4,592,692 | 6/1986 | Suizu et al. | 414/792.8 |
| 4,624,455 | 11/1986 | Radek et al. | 414/793.4 |

FOREIGN PATENT DOCUMENTS

| | | | |
|---|---|---|---|
| 2721675 | 11/1978 | Germany | 414/792.8 |
| 3907332 | 7/1990 | Germany | 414/792.9 |

*Primary Examiner*—Karen B. Merritt
*Assistant Examiner*—Douglas Hess
*Attorney, Agent, or Firm*—Max Fogiel

[57] ABSTRACT

A device for laying on and stacking off cut stacks of sheets of material for the purpose of constructing overall stacks. The device includes a counter that travels vertically up and down and horizontally in and out, a mechanism that lays the cut stack onto the counter, and a mechanism that secures the cut stack as the counter travels out in order to stack off the cut stacks. The front of the counter tapers in. The counter has a forward section and a rear section for accommodating the cut stack. The forward section pivots on the rear section and can be pivoted between two limiting positions by applying a force such that in one position the surfaces of the two sections constitute a horizontal plane and in the other position the surface of the forward section slopes down from that of the rear section. Such a device is compact and ensures ideal laying on and stacking off of the cut stack.

12 Claims, 2 Drawing Sheets

DEVICE FOR LAYING ON AND STACKING OFF CUT STACKS OF SHEETS OF MATERIAL

BACKGROUND OF THE INVENTION

The present invention concerns a device for laying on and stacking off cut stacks of sheets of material for the purpose of constructing overall stacks. The device includes a counter that travels up and down and in and out, a mechanism that lays the cut stack onto the counter, and a mechanism that secures the cut stack as the counter travels out in order to stack off the cut stacks. The front of the counter tapers in.

A device of this type is known from U.S. Pat. No. 4,055,261. Once a stack has been cut, it is moved to the counter and laid thereon for the purpose of stacking it off straight onto a pallet or onto other cut stacks already on the pallet. The counter is accordingly raised until its lower surface is as close as possible to the upper surface of the pallet or of the stack thereon. The counter is in one piece, and its front is pointed. The surface of the counter in the vicinity of the point slopes down toward it. The purpose of the point is to minimize the drop between the counter and the pallet or the stack resting on it ensuring satisfactory stacks. The cut stack of sheets of material resting on the counter is laid on in the vicinity of the horizontal surface immediately adjacent to the section that tapers in toward the front to create the point. The point incorporates several cutouts, allowing a system of grippers to secure the stack as the counter retracts and prevents it from moving along with the counter.

The known device has a drawback. The conically tapering section of the counter is needed only for stacking off the cut stack. Although the design does ensure horizontal paper orientation, it results in a longer overall counter. The device occupies more space and is more expensive to manufacture.

Loading a stack lay-on counter of this shape so that the cut stack of sheets of material rests not only in the vicinity of the section of the single-part counter with the horizontal surface but the conically tapering section as well is known in practice. This approach does have the advantages that the entire length of the counter is exploited and that the overall device can be smaller. Still, there is the drawback that the entire resting surface of the cut stack that is to be stacked off is not horizontally positioned but slopes in the vicinity of the point. Due to the deflection of the stack, this factor dictates a displacement of the individual sheets, resulting in less precise stacking off.

A device for stacking off products, especially books, brochures, and similar articles, is known from German 3 843 794 A1. The products are positioned on a counter and supplied mechanically to a product layoff by way of a thrust-off slab that pivots on the counter. The free forward end of the thrust-off slab rests on the last layer of product laid off in the product layoff. A forklift truck is known from German GM 7 115 077. This truck is also provided with a pivoting thrust-off slab. The truck is intended to accommodate a separate push-off slab with a load resting on the slab. The push-off slab not only helps push the load on and off, but is also used to introduce flat pallets or flat but flexible stack supports in a clamping accessory for forwarding to the push-off slab.

SUMMARY OF THE INVENTION

The object of the present invention is a device of the aforesaid genus that will be compact and will ensure ideal laying on and stacking off of the cut stack.

This object is attained in accordance with the present invention in the generic device in that the counter has a forward section and a rear section for accommodating the cut stack, whereby the forward section pivots on the rear section and can be pivoted between two limiting positions by means of applying force such that in one position the surfaces of the two sections constitute a horizontal plane and in the other position the surface of the forward section slopes down from that of the rear section.

The design in accordance with the present invention ensures that the cut stack of sheets of material accommodated on the counter will be accommodated on the whole horizontal surface of the counter while the forward section is in the upper limiting position, allowing the stack to be laid on in the shape of a parallelepiped, with no sheets displaced, that is. The total length of the forward section can accordingly be exploited to lay the stack on. For stacking off as such, the forward section will be lowered until its front is almost next to the pallet or the stack resting thereon. The counter can then be retracted with the mechanisms that secure the cut stack in action.

The cut stack can be laid on and/or secured in various ways and means. A stop with a vertical lay-on surface can be lowered onto the front of the forward section, allowing the cut stack to be positioned against it manually or mechanically. It is also conceivable to provide several such stops that can be approached to opposite sided of the parallelepipedal stack. The mechanism for securing the cut stack can be designed in various ways. How depends for example on whether a stack of sheets of material is to be stacked off or whether the stack is composed of a number of subsidiary stacks. When the stack is composed of a number of subsidiary stacks, it will be of advantage for the mechanism for securing the cut stack to be a stop with a vertical impact surface that can be positioned behind the stack and laid against its facing surface, preventing the stack from retreating when the counter retracts. Basically, the mechanism for securing the cut stack can also be a system of grippers that preferably grab the stack in the vicinity of its forward face. It is generally considered practical to employ grippers when sensitive papers are being stacked off or when particularly satisfactory stacks are necessary.

Different forward sections can be employed with the same rear section in some advantageous embodiments of the present invention, depending on the particular material being stacked off. The forward sections can in particular have different points, with and without gripper cutouts, gripper cutouts in different positions depending on the stack footprint, and even air nozzles in the surface of the counter.

The forward section in one particularly simple device can be pivoted, especially pneumatically, between two stops relative to the rear section. It is in this event adequate for the surface of the forward section to pivot less than 10° out of the horizontal.

Further characteristics of the present invention are recited in the subsidiary claims and in the specification and are illustrated in the drawing. All characteristics and combinations thereof are essential to the invention.

BRIEF DESCRIPTION OF THE DRAWINGS

Two embodiments of the present invention will now be specified by way of example and without restricting its scope to them in any way with reference to the accompanying simplified drawing, wherein.

DESCRIPTION OF THE PREFERRED EMBODIMENTS

Figure 1:
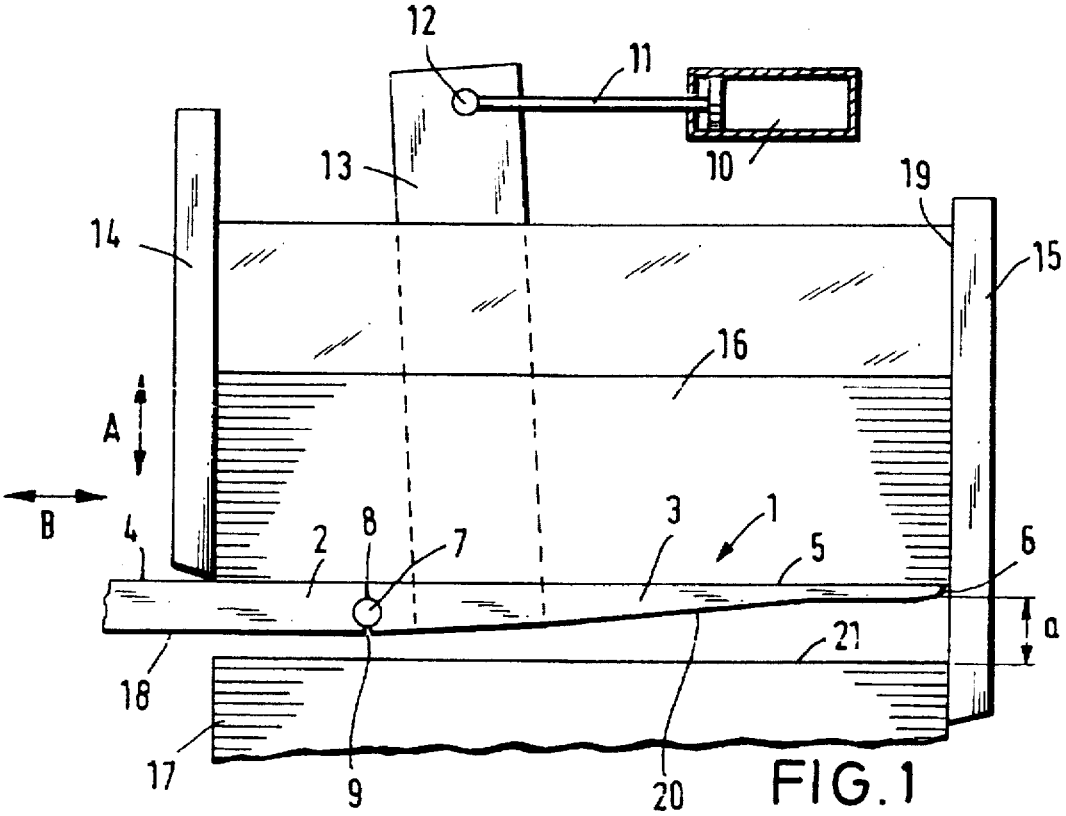
FIG. 1 is a side view of the components relevant to the present invention of one embodiment of a device in accordance therewith with the forward section raised.

FIG. 1 illustrates only the front of a counter 1 comprising a forward section 3 and a rear section 2. Both sections are equal in width (perpendicular to the extension of the sheets). The surface 4 of rear section 2 and the surface 5 of forward section 3 are horizontal and rectangular. Forward section 3 tapers in conically to a point 6. Sections 2 and 3 pivot against each other around a shaft 7. With forward section 3 pivoted into its upper limiting position, its surface 5 constitutes in conjunction with the surface 4 of rear section 2 a horizontal surface. With the forward section 3 of counter 1 pivoted down, its surface 5 slants approximately 7° from the horizontal. In either its upper or its lower limiting position, forward section 3 is in contact with rear section 2 at points 8 and 9, away from shaft 7. Forward section 3 can be pivoted by a pneumatic cylinder 10. An associated piston rod 11 engages a control lever 13 by way of a bearing shaft 12. Control lever 13 extends more or less perpendicular to the surface 5 of forward section 3 and is fastened laterally to that section. Pneumatic cylinder 10 is attached to front section 3 and travels along with it.

Rear section 2 rides in an unillustrated carriage that allows it and hence forward section 3 as well to travel vertically in the direction indicated by double-headed arrow A and horizontal in the direction indicated by double-headed arrow B.

The device includes, finally, a rear stop 14 and a forward stop 15. Rear stop 14 can be moved in the directions indicated by double-headed arrows and forward stop 15 at least in the direction indicated by double-headed arrow A and preferably also in that indicated by double-headed arrow B. Both stops 14 and 15 could if necessary also be moved back and forth perpendicular to the surface of the sheets. The means of moving rear section 2 and stops 14 and 15 are not illustrated.

The illustrated device is employed to lay a cut upper stack 16 of sheets of material on, and to stack it off onto another only partly illustrated stack 17 of sheets of material resting on an unillustrated pallet for the purpose of creating an overall stack. As will be evident from FIG. 1, counter 1 is positioned with its forward section 3 raised into the upper limiting position at a level, where the lower surface 18 of rear section 2 is slightly above the upper surface of lower stack 17. Counter 1 is then loaded with upper stack 16 and advanced until forward section 3 is above lower stack 17 and its point 6 is almost in contact with the lay-on surface 19 of forward stop 15 that is perpendicular to the extension of the sheets. Rear stop 14 is then advanced toward forward stop 15, forcing upper stack 16 as will be evident from FIG. 1 against forward stop 15. Lateral stops similar to rear stop 14 but acting perpendicular to the extension of the sheets can if necessary be provided to straighten upper stack 16 from the sides.

Figure 2:
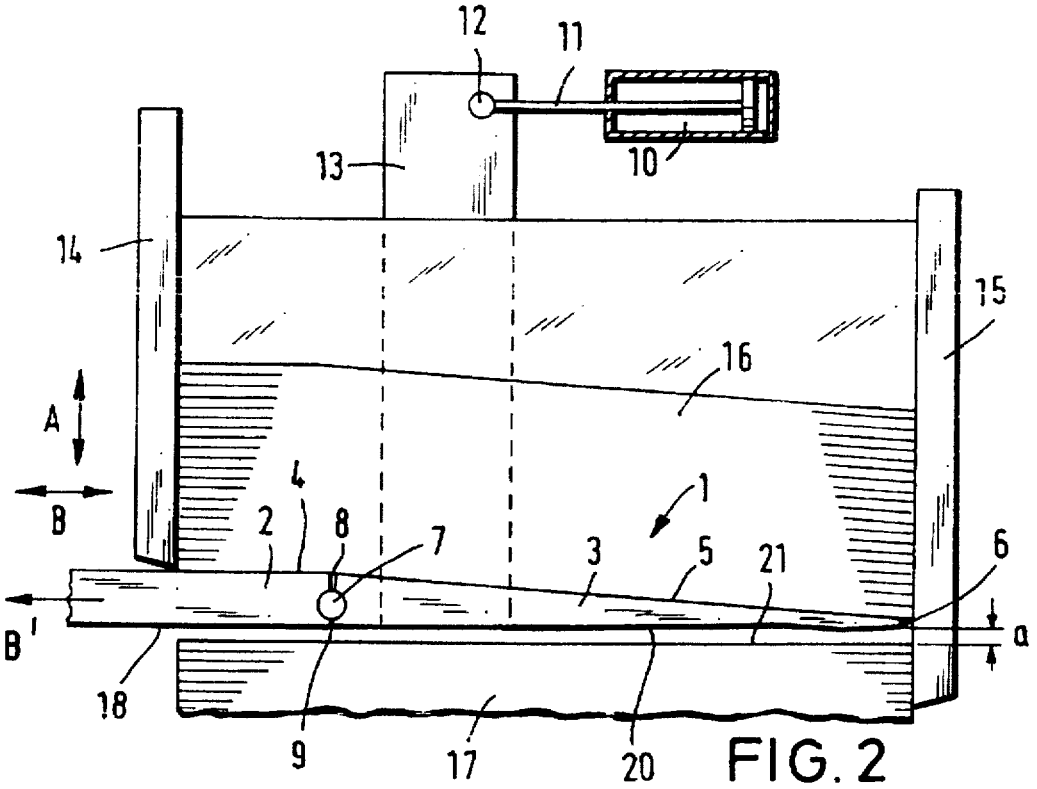
FIG. 2 is a view similar to that in FIG. 1 with the forward section lowered.

As will be evident from FIG. 1, the laid-on upper stack 16 rests between stops 14 and 15 on the horizontal surface of counter 1. With this situation as a point of departure, forward section 3 is pivoted down to its lower limiting position by pneumatic cylinder 10 as illustrated in FIG. 2. Upper stack 16 will now not have as far to drop in the vicinity of the point 6 on forward section 3. With forward section 3 down, its lower surface 20 will be at the same level as the lower surface 18 of rear section 2. Lower surface 20 will be nearer the upper surface 21 of lower stack 17, allowing counter 1 to be extracted below upper stack 16 without coming into contact with lower stack 17. Rear stop 14 will simultaneously prevent upper stack 16 from accompanying the retracting counter 1. The counter retraces in the direction indicated by arrow B' in FIG. 2.

Figure 3:
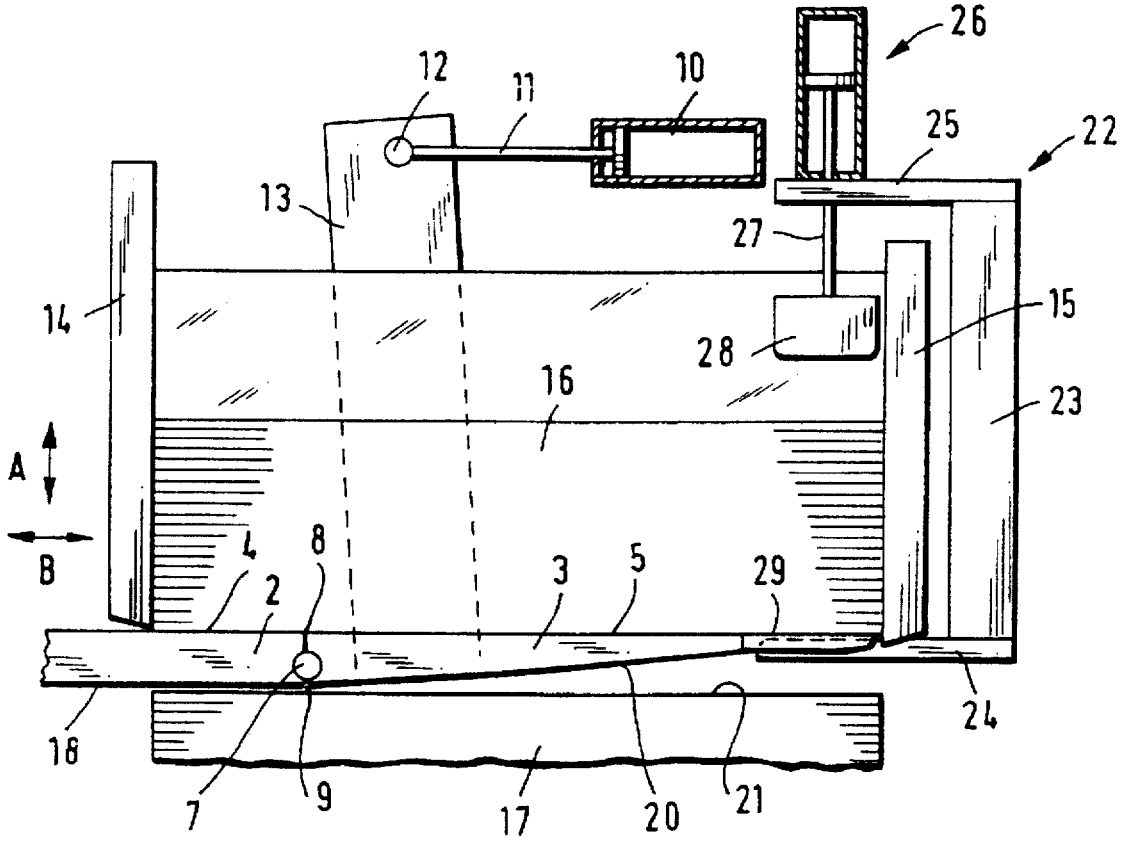
FIG. 3 is a view similar to that in FIG. 1 of another embodiment, also illustrating a gripper system.

The embodiment illustrated in FIG. 3 includes a gripper system 22 in the vicinity of forward stop 15. Gripper system 22 travels back and forth in the carriage in accordance with the direction traveled by stops 14 and 15. System 22 comprises a lower pressure-application component 24, an upper pressure-application component 28, and a pneumatic cylinder 26. Pressure-application component 24 is attached to a gripper carriage 23. Upper pressure-application component 28 is mounted on the end of a piston rod 27 associated with cylinder 26 and traveling toward and away from pressure-application component 24. To enable gripper system 22 to intercept upper stack 16 at the front, the front of forward section 3 is provided with a cutout 29. To intercept the stack, pressure-application component 24 is advanced between stacks 16 and 17 and applied to the bottom of upper stack 16 while upper pressure-application component 28 presses down against the top. As forward section 3 drops into the position illustrated in FIG. 2, gripper system 22 accompanies it and retracts.

If upper stack 16 comprises several subsidiary stacks, especially stacks produced by cuts perpendicular to the extension of the sheets, upper stack 16 will be stripped off only by rear stop 14. If the subsidiary stacks are produced only by cuts paralleling the extension of the sheets, the stack can be retained by a gripper system 22 comprising several parallel lower pressure-application components 24 and upper pressure-application components 28 or with only one continuous upper component 28 along with cutouts 29 for each lower component 24.

We claim:

1. An arrangement for laying on and stacking off cut stacks of sheets of material for constructing overall stacks, comprising: a table counter traveling vertically up and down and horizontally back and forth; means for laying a cut stack onto said counter; means for securing said cut stack as said counter travels back to stack off the cut stack, said counter having a front side tapering conically; said counter having a forward section and a rear section for receiving the cut stack, said forward section being pivotable on said rear section between two limiting positions through an applied force, said two sections having surfaces forming a horizontal plane in one of said limiting positions, the surface of said forward section sloping down from the surface of said rear section in the other one of said limiting positions; said forward section having a length shaped conically over at least part of the length.

2. An arrangement as defined in claim 1, including two stops between which said forward section is pivotable in relation to said rear section.

3. An arrangement as defined in claim 1, wherein said forward section is pivotable pneumatically.

4. An arrangement as defined in claim 1, wherein said surface of said forward section pivots less than 10° from the horizontal.

5. An arrangement as defined in claim 1, wherein said rear section has a lower surface and said forward section has a lower surface forming a horizontal surface with the lower surface of said rear section when said forward section is pivoted down.

6. An arrangement as defined in claim 1, including a rear stop behind the cut stack in a forward direction of travel of said table counter.

7. An arrangement as defined in claim 1, including a forward stop in front of the cut stack in a forward direction of travel of said table counter.

8. An arrangement as defined in claim 1, including gripping means in front of the cut stack in a forward direction of travel of said table counter.

9. An arrangement as defined in claim 8, wherein said forward section has a front side with at least one cutout to receive at least one pressure-application means in said gripping means.

10. An arrangement as defined in claim 1, including air nozzle means in said forward section adjacent to the surface of said forward section.

11. An arrangement as defined in claim 1, wherein said rear section is connectable to said front section with varying taper.

12. An arrangement for laying on and stacking off cut stacks of sheets of material for constructing overall stacks, comprising: a table counter traveling vertically up and down and horizontally back and forth; means for laying a cut stack onto said counter; means for securing said cut stack as said counter travels back to stack off the cut stack, said counter having a front side tapering conically; said counter having a forward section and a rear section for receiving the cut stack, said forward section being pivotable on said rear section between two limiting positions through an applied force, said two sections having surfaces forming a horizontal plane in one of said limiting positions, the surface of said forward section sloping down from the surface of said rear section in the other one of said limiting positions; said forward section having a length shaped conically over at least part of the length; two stops between which said forward section is pivotable in relation to said rear section; said forward section being pivotable pneumatically; the surface of said forward section pivoting less than 10° from the horizontal; said rear section having a lower surface and said forward section having a lower surface forming a horizontal surface with the lower surface of said rear section when said forward section is pivoted down; a rear stop behind the cut stack in a forward direction of travel of said table counter; a forward stop in front of the cut stack in said forward direction of travel of said table counter; gripping means in front of the cut stack in said forward direction of travel of said table counter; said forward section having a front side with at least one cutout to receive at least one pressure-application means in said gripping means; air nozzle means in said forward section adjacent to the surface of said forward section; said rear section being connectable to said forward section with varying taper.

* * * * *